United States Patent [19]

Abbott et al.

[11] 3,999,514

[45] Dec. 28, 1976

[54] MAGNETIC BRUSH DEVELOPER

[75] Inventors: Jerry J. Abbott; Charles A. Campbell, both of Longmont; Allison H. Caudill, Lafayette; John A. Thompson, Boulder, all of Colo.

[73] Assignee: International Business Machines Corporation, Armonk, N.Y.

[22] Filed: Sept. 29, 1975

[21] Appl. No.: 617,777

[52] U.S. Cl. ..... 118/657; 355/3 DD

[51] Int. Cl.[2] ..... G03G 13/00; G03G 15/00

[58] Field of Search ..... 118/637; 222/1; 355/3 DD, 427/25

[56] References Cited

UNITED STATES PATENTS

| | | | |
|---|---|---|---|
| 3,487,978 | 1/1970 | Gawron | 222/1 |
| 3,664,299 | 5/1972 | Shaler | 118/637 |
| 3,764,208 | 10/1973 | Takahashi et al. | 118/637 |
| 3,883,240 | 5/1975 | Ho et al. | 355/3 DD |

*Primary Examiner*—Henry S. Jaudon
*Attorney, Agent, or Firm*—Francis A. Sirr

[57] ABSTRACT

An auger fed magnetic brush developer wherein two parallel augers continuously recirculate the developer mix and cause the mix to be enriched with toner prior to its being returned to the magnetic brush roll.

A supply auger communicates with the brush roll along its entire length and directly elevates the mix to a lower part of the brush roll's surface. This supply auger includes four flutes of a pitch equal to one-half the length of the brush roll. This auger flute arrangement insures that a uniform supply of mix is presented to the brush roll along its entire length. In addition, this supply auger construction insures that a uniform supply of enriched mix is presented to the brush roll along its entire length, since the gradually depleting carrier tends to be presented to the brush roll a minimum number of times, for example three, prior to its exiting one end of the supply auger.

The carrier exiting the supply auger enters a turnaround compartment whereat new toner is added. The depleted carrier and new toner is mixed by a return auger. To insure adequate triboelectric agitation, the return auger includes two flutes of a pitch equal to that of the supply auger. The two augers are rotated at different flute and pitch related speeds which insure equal flow through the augers.

The two augers are of equal length, and are longer than the brush roll. The two augers are mounted in axially offset fashion, with the opposite end of each auger substantially coextensive with opposite ends of the brush roll, and with the other end of each auger extending into end disposed turnaround compartments.

16 Claims, 3 Drawing Figures

MAGNETIC BRUSH DEVELOPER

BACKGROUND AND SUMMARY OF THE INVENTION

This invention relates to magnetic brush development apparatus for use in developing the latent image in the dry electrophotographic process known as xerography. This process involves the formation of a latent electrostatic image on or in a photoconductor, such that a visible image can be produced by bringing dry, colored developing powder, called toner, having a proper polarity electrical charge, into physical contact with the photoconductor. Toner can be formulated to carry either a positive or a negative electrostatic charge.

Toner is often used as one constituent of a two-component developer mix. The other component is a relatively large particle called the carrier bead. These beads are selected from the triboelectric series such that agitation of the beads and toner causes a charge of the opposite polarity to reside on each. The small toner particles coat the carrier beads by electrostatic attraction.

One of the well known types of developing apparatus is the magnetic brush developing apparatus. In this apparatus the above-mentioned bead component of the developer mix is a magnetically permeable bead which is magnetically held against the surface of a rotating nonmagnetic tube, known as the brush roll. This mix is made to form a brush or bristle-like shape at the developing nip interface between the brush roll and a closely-spaced photoconductor. When this developer mix bristle-like shape is brought into physical contact with the photoconductor, the photoconductor's latent image, which is of opposite polarity to that of the toner, succeeds in causing toner to transfer from the carrier beads to the photoconductor, thus forming a visible toner image. The carrier beads are thus depleted of toner, and must be subsequently enriched with new toner which is added to the developer mix from a toner supply chamber or cartridge.

Such a magnetic brush developer roll must, of course, extend completely across that length of the photoconductor which contains a latent image. The entire length of this development nip must be continuously supplied with developer mix having sufficient toner, of a proper charge, to adequately develop whatever pattern latent image may exist on the photoconductor.

The present invention is directed to a magnetic brush developer whose developer mix is continuously recirculated by a supply and a return auger of unique construction. Specifically, these two augers have a multiflute auger construction whose pitch and speed insure adequate mix agitation for proper triboelectric charging, and insure an adequate supply of toner-rich mix along the length of the developer roll.

More specifically, the entire length of the magnetic brush roll is supplied with developer mix by a supply auger. This auger is longer than the brush roll and its discharge end is substantially flush with one end of the brush roll. The discharge end of the supply auger operates to deposit depleted carrier into a first turnaround compartment whereat new toner is added as needed. The intake end of the supply auger extends beyond the other end of the brush roll, into a second turnaround compartment.

A return auger of substantially the same length as the supply auger is axially offset therefrom, so that its exit end is substantially flush with said other end of the brush roll. The intake end of the return auger extends beyond said one end of the brush roll and operates to transport the depleted carrier and new toner from the first turnaround compartment to the exit end of the return auger, mixing and charging the same as it does so. The exit end of the return auger communicates with the second turnaround compartment whereat the now enriched and charged mix returns to the intake end of the supply auger for presentation to the brush roll.

The function of the supply auger is to insure a uniform supply of toner-rich developer mix along the entire length of the brush roll. As can be appreciated, a given carrier bead will be somewhat depleted of toner each time it is presented to the photoconductor. Thus, the supply auger is constructed and arranged to present a given carrier bead to the photoconductor a predetermined number of times as it travels the length of the supply auger. Exemplary, the supply auger contains four flutes of a pitch equal to one-half the length of the brush roll.

The primary function of the return auger is to insure proper mixing and triboelectric charging of the toner and carrier beads. Exemplary, the return auger includes two flutes of a pitch equal to the pitch of the supply auger.

Since the recirculating developer mix must have the same flow rate through both augers, their rotary speeds are related as are their diameters, the number of flutes, and the flute pitch. Preferably, the augers are made of material selected to have little or no affinity for either the charged toner or the charged carrier.

The foregoing and other features and advantages of the invention will be apparent from the following more particular description of a preferred embodiment of the invention, as illustrated in the accompanying drawing.

DESCRIPTION OF THE PREFERRED EMBODIMENT

Figure 1:
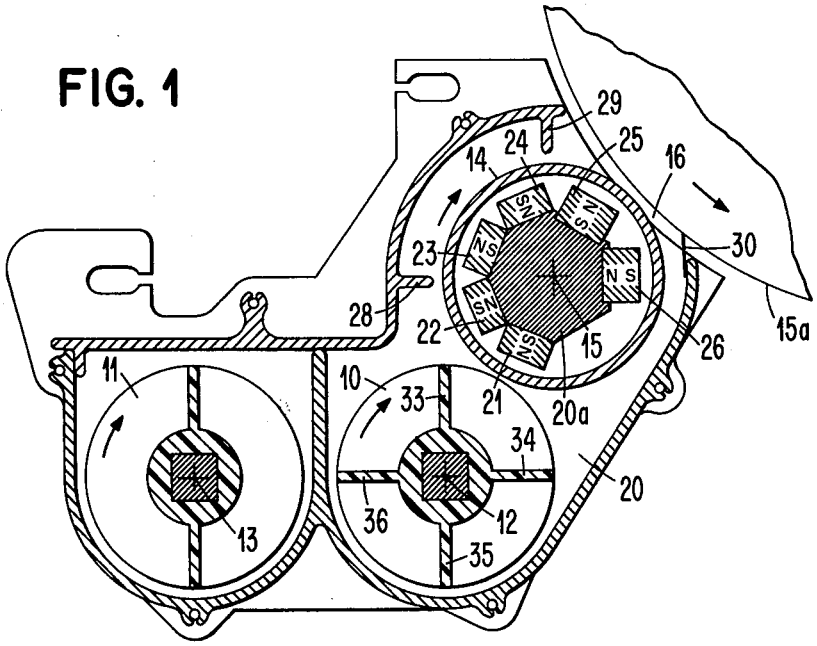
FIG. 1 is a side section view of a magnetic brush developer embodying the present invention, taken along section line 1—1 of FIG. 2.

Referring to FIG. 1, this Figure discloses a preferred horizontal orientation of the supply auger 10 and the return auger 11, wherein these augers rotate in a clockwise direction about parallel axes 12 and 13, these two axes lying in a substantially horizontal plane. Supply auger 10 lies beneath magnetic brush roll 14, this roll being rotatable clockwise about axis 15. Axis 15 is parallel to above-mentioned axes 12 and 13 and is parallel to the axis of photoconductor drum 15*a*. While the present invention is not limited thereto, photoconductor drum 15*a* rotates in a counterclockwise direction, such that "parallel" development occurs at development nip 16.

Figure 2:
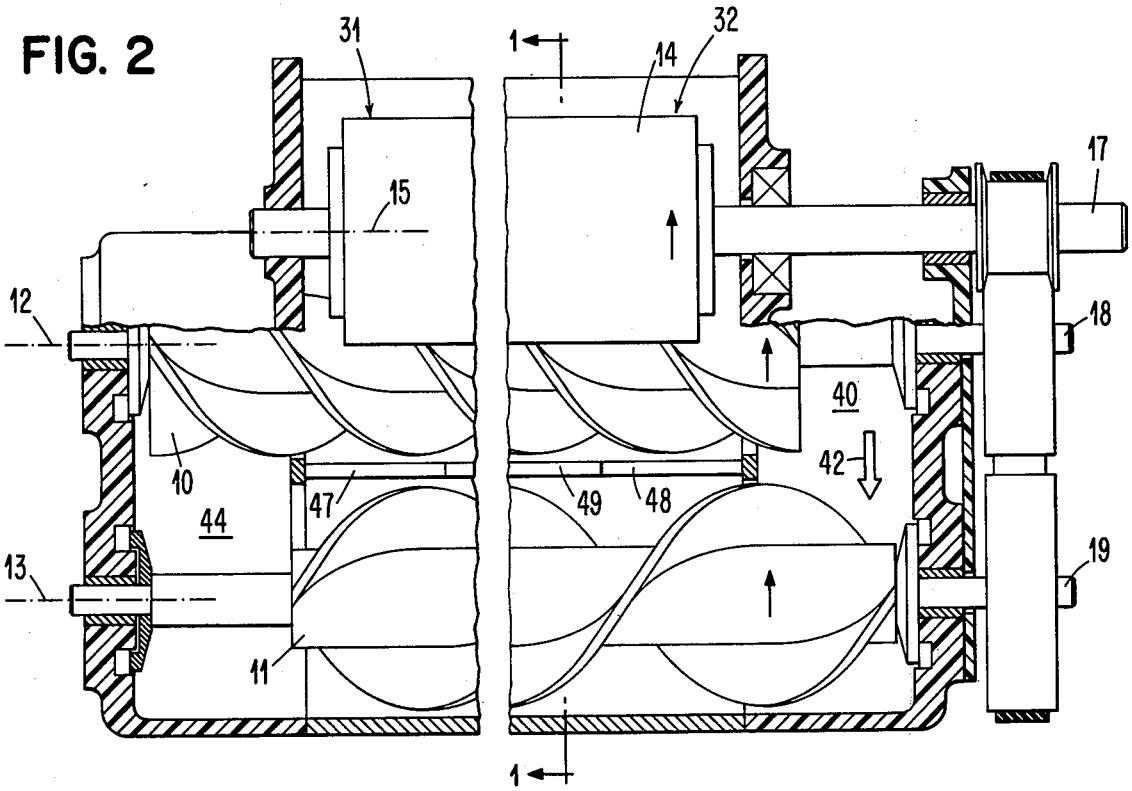
FIG. 2 is a top section view of the developer of FIG. 1, showing the center portion broken away, and taken along section line 2—2 of FIG. 3.

The parallel orientation of the axes of supply auger 10, return auger 11 and nonmagnetic brush roll 14 is better shown in FIG. 2. The axial length of brush roll 14, as shown in FIG. 2, is slightly less than the axial length of photoconductor drum 15*a*. The usable portion of the drum, that is, the portion which can be developed by the magnetic brush developer, is defined by the length of brush roll 14, and may be, for example, fifteen inches long. The shafts 17, 18 and 19 are rotatably supported by bearings in the nonmagnetic housing of the magnetic brush developer and are operable, by means of drive couplings connected to shaft 17, not shown, to produce clockwise rotation of return auger 11, supply auger 10 and brush roll 14.

The developer mix, comprising carrier beads and toner, resides in the recirculating path defined by the return auger and the supply auger, and a residual supply of this mix resides within the axially extending portion 20 of the developer housing (FIG. 1) immediately adjacent and extending the axial length of supply auger 10.

A magnetic field generating cluster is mounted at a stationary position within brush roll 14, as shown in FIG. 1. This cluster comprises a ferromagnetic iron core 20, which extends the axial length of the brush roll, and which supports magnets 21–26. Magnets 21–26 generally extend the length of brush roll 14, being somewhat spaced inwardly from the ends of the roll.

To prevent carryout of the beads at the end of the magnetic brush roll, it may be preferable to provide pickup and transport magnets 21–24 which are shorter in axial length than is the axial length of developing magnet 25 and scavenging magnet 26. The magnetic orientation of these magnets is as shown. The magnetic field generated by pickup magnet 21 pulls the magnetic carrier beads from the top of the supply auger against the outer cylindrical surface of nonmagnetic brush roll 14. As the brush roll rotates in a clockwise direction, these magnetic carrier beads are transported to the top of the brush roll by transport magnets 22, 23 and 24. As these carrier beads so move, they first encounter a lower doctor blade 28. This doctor blade extends the axial length of the brush roll and operates to scrape off excess carrier beads and thereby generate a uniform bead coating on the cylindrical surface of the brush roll. This uniform coating of carrier beads is further dressed by upper doctoring blade 29, this blade also extending the length of the brush roll. Magnets 22–24 hold the carrier beads onto the surface of the clockwise rotating brush roll until the beads encounter the developing magnetic field generated by developing magnet 25. Magnet 25 operates to cause the carrier beads to be formed into an outstanding brush or bristle-like formation which physically engages the outer circumferential surface of the advancing photoconductor drum 15*a*. As is well known to those of skill in the art, photoconductor drum 15*a* carries an electrostatic latent image of an electrical potential opposite to the potential of the toner which coats the carrier beads. As a result, the toner is attracted to the photoconductor and leaves the surface of the carrier. In this manner, a visible toner image is formed or developed on the surface of the photoconductor drum, downstream from developing nip 16. As is well known, it may be desired to provide a development electrode electrical bias voltage to magnetic brush roll 14 to accomplish solid area development.

After the photoconductor's latent image is developed at the developing nip, the now somewhat depleted carrier beads are pulled back into the magnetic brush developer by scavenging magnet 26. Magnet 26 operates to prevent a carryout of the developer mix on the surface of the photoconductor drum 15*a*. This carryout prevention effect is also aided by a seal at 30 which extends the axial length of the magnetic brush developer.

As can be seen from FIG. 1, these somewhat depleted beads now fall off into the area 20 of housing which is supplying developer mix to the underside of the clockwise rotation supply auger 10. The rotation of auger 10 forces the beads to pass around the underside of the auger and to be mixed with other beads before being picked up a second time by pickup magnet 21, after these beads reach the top of the supply auger. In addition to mixing the somewhat depleted beads with other beads before passing them a second time to the pickup magnet, the beads are also translated axially along the auger so that the second time they are picked up by pickup magnet 21, they are further downstream of the supply auger.

Figure 3:
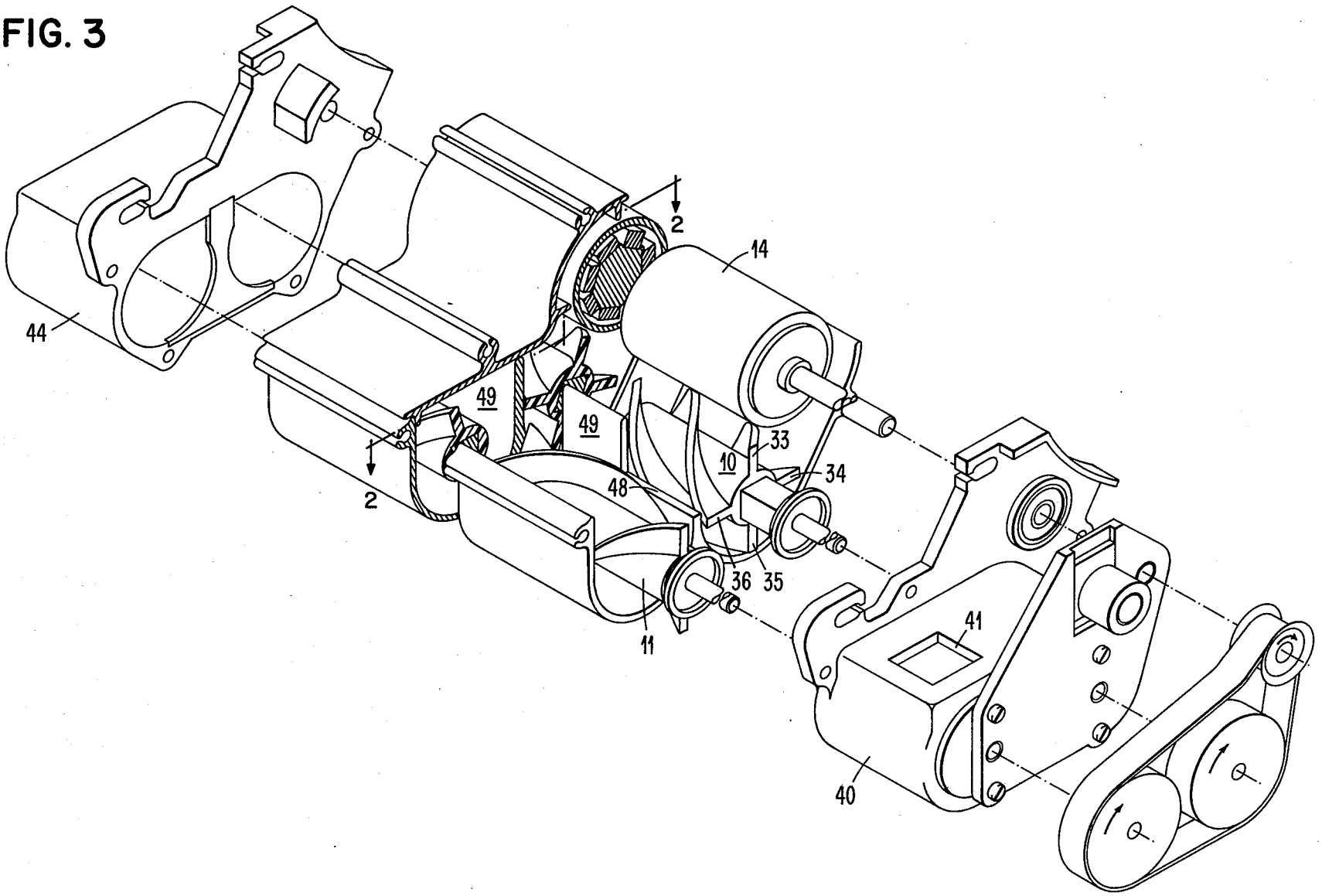
FIG. 3 is an exploded view of the developer of FIG. 1, again showing the center portion broken away.

With reference to FIG. 2, supply auger 10 is constructed and arranged such that should a given bead be presented to the brush roll at point 31 the first time, the second presentation to the brush roll would occur at approximately in the middle of the roll, not shown, and the bead would be presented for a third and last time at point 32 near the right-hand end of the roll. In order to produce this optimum type of bead movement, supply auger 10 comprises a four-flute right-hand auger, as best seen in FIG. 3, wherein the flutes are identified as 33, 34, 35 and 36. In an exemplary configuration, these four flutes extend at 45° to the rotational axis of the supply auger.

As can be seen in FIG. 2, the clockwise rotation of supply auger 10 is operable to deliver depleted developer mix to a first turnaround chamber 40 whereat new toner is supplied through an opening 41, by a toner replenisher, not shown (FIG. 3). This toner replenisher may be open loop controlled; that is, toner may be added as a function of the movement of photoconductor drum 15*a*. In the alternative, a closed loop toner concentration sensor may be provided to supply new toner to first turnaround compartment 40 as a function of the toner actually used.

The developer mix moves into the right-hand intake end of the return auger, as shown by arrow 42. If desired, a special short pitch auger section may be provided at the right-hand intake end of the return auger. The return auger functions to stir and triboelectrically charge the developer mix as the mix moves down the length of the return auger to a second turnaround compartment 44 adjacent the left-hand intake end of the supply auger. In order to produce optimum mixing, return auger 11 preferably comprises a two-flute auger, having flutes identified as 45 and 46 in FIG. 3. It is preferable that the pitch of flutes 45 and 46 be equal to that of supply auger 10.

In order to present a given carrier bead to the magnetic brush roll approximately three times as the bead traverses the axial length of supply auger 10, it is preferable that the pitch of the flutes in the supply auger be equal to approximately half of the length of the brush roll. In the cited example where the brush roll may be fifteen inches long, the pitch of the flutes in the supply auger is preferably 7½ inches.

It is essential that the horizontal level of the carrier mix, as it reaches the top of supply auger 10, be uniform across the axial length of the supply auger, such that a uniform supply of mix is presented to the surface of the clockwise rotating brush roll. While the developer mix transfers from the discharge end of one auger to the intake end of the other auger at turnaround compartments 40 and 44, special cross-over openings 47 and 48 may be provided in wall member 49 which separates the augers one from the other. In this manner, adequate flow at the turnaround points is insured. For example, should there be a resistance or hesitancy of the carrier mix to enter turnaround compartment 44 (FIG. 2), then the carrier mix would spill over through opening 47 and an adequate supply of mix to the supply auger, and thus to the brush roll, is insured.

As can be seen from FIG. 3, the supply and return augers are provided with a maximum depth flute, with a minimum auger portion being devoted to the center flute supporting section of the augers. Thus, maximum mix flow is provided through the augers. In addition, it is desirable that the augers be constructed of a material which has low affinity for either the toner or the carrier.

In an exemplary embodiment of the present invention, the surface speed of photoconductor drum 15*a* was 20 inches per second, the surface speed of the magnetic brush roll 14 was 60 inches per second, the brush roll had a diameter of 1.75 inches, as did the supply and return augers, while the supply auger rotated at a speed of 200 revolutions per minute and the return auger rotated at a speed of 185 revolutions per minute. These relative proportions caused a given carrier bead to travel one-third of the way down the axial length of the supply auger as the photoconductor moved approximately one-half inch through development nip 16. The separation of the supply auger to the brush roll was approximately 0.06 inch, whereas the lower and upper doctor blades were separated from the supply roll by approximately 0.09 and 0.09 inches, respectively. The separation of the brush roll from the photoconductor's surface was 0.05 inch.

As can be seen from FIG. 3, the four-flute auger comprising supply auger 10 is a right-hand auger and clockwise rotation of this auger causes the mix to move from the left to the right. The two-flute return auger 11 is a left-hand auger, and clockwise rotation of this auger causes the developer mix to move from right to left.

As can be seen in FIG. 2, augers 10 and 11 are of approximately the same axial length. However, they are offset such that the right-hand take-up end of return auger 11 extends into turnaround compartment 40, whereas the discharge end of this auger terminates approximately at the left-hand end of the brush roll. Supply auger 10 is offset such that its left-hand take-up end extends into turnaround compartment 44 and its discharge end terminates at turnaround compartment 40, extending somewhat beyond the right-hand end of brush roll 14.

From the above description, it can be seen that a unique magnetic brush developer has been provided wherein a supply and return auger provide sufficient carrier bead circulation, as by the combination of a four and a two-flute auger, to provide developer mix aqitation and charging commensurate with the addition of new toner at a turnaround portion of the auger recirculating flow pattern. Furthermore, the four-flute supply auger insures an even supply of toner laden carrier along the axial length of the brush roll. The structural cooperation of the brush roll and the supply auger is such that the supply auger elevates the developer mix into the influence of the brush roll's pickup magnet, and the brush roll's scavenging magnet insures that somewhat depleted carrier mix is supplied to the underside of the supply auger, such that the supply auger operates to transport this carrier axially of the brush roll and operates to mix the carrier before it is again presented to the photoconductor being developed, at an axially displaced point along the brush roll.

While the invention has been particularly shown and described with reference to a preferred embodiment thereof, it will be understood by those skilled in the art that various changes in form and details may be made therein without departing from the spirit and scope of the invention.

What is claimed is:

1. An auger fed magnetic brush developer wherein toner coated magnetic carrier is supplied to a rotating magnetic brush roll at a pickup zone, to be conveyed by said brush roll to an elevated development zone, the improvement comprising:

a multiflute supply auger having a length at least as great as the length of said brush roll, means mounting said supply auger with one end thereof substantially coextensive with one end of said brush roll and communicating with a first turnaround compartment to deliver depleted carrier thereto, the other end of said supply auger communicating with a second turnaround compartment to receive enriched carrier therefrom, said supply auger rotating on an axis which is below the axis of said brush roll and operable as a result of auger rotation to elevate enriched carrier above its axis into direct engagement with said brush roll at said pickup zone, and operable to receive depleted carrier from said brush roll at a zone which is spaced from said pickup zone in the direction of rotation of said supply auger, said supply auger having a relatively large number of flutes to insure uniform distribution of enriched carrier along the length of said brush roll's pickup zone, said flutes having a relatively long pitch to insure that depleted carrier is reelevated to said pickup zone a minimum number of times prior to its being delivered to said first turnaround compartment, a multiflute return auger having a length substantially equal to the length of said supply auger, said return auger having a relatively small number of flutes to insure adequate resupply of toner to the depleted carrier prior to delivery of said depleted carrier to said second turnaround compartment.

means mounting said return auger with one end thereof substantially coextensive with said other end of said brush roll and communicating with said second turnaround compartment to deliver enriched carrier thereto, the other end of said return auger communicating with said first turnaround compartment to receive depleted carrier therefrom, housing means separating said supply and return augers with the exception of said first and second turnaround compartments, means for supplying new toner to said first turnaround compartment, and drive means connected to rotate said supply and return augers at speeds which insure equal continuous flow through said augers and turnaround compartments with no buildup of carrier.

2. the developer defined in claim 1 wherein the pitch of said supply auger is related to the length of said brush roll in the ratio of approximately 1 to 2.

3. The developer defined in claim 2 wherein said supply and return augers are of substantially the same diameter, have substantially the same pitch, and said return auger rotates at a lower speed than said supply auger.

4. The developer defined in claim 3 wherein the number of flutes on said supply auger is related to the number of flutes on said return auger in the ratio of approximately 2 to 1.

5. The developer defined in claim 4 wherein said supply and return augers are formed of a material having a low triboelectric affinity for said toner.

6. The developer defined in claim 5 wherein said supply and return augers are longer than said brush roll, wherein said supply auger is mounted with one end thereof substantially coextensive with one end of said brush roll and communicates with said first turnaround compartment, wherein the other end of said supply auger extends beyond the other end of said brush roll into said second turnaround compartment, wherein said return auger is mounted with one end thereof substantially coextensive with said other end of said brush roll and communicates with said second turnaround compartment, and wherein the other end of said return auger extends beyond said one end of said brush roll into said first turnaround compartment.

7. the developer defined in claim 1 wherein said supply and return augers are longer than said brush roll, wherein said supply auger is mounted with one end thereof substantially coextensive with one end of said brush roll and communicates with said first turnaround compartment, wherein the other end of said supply auger extends beyond the other end of said brush roll into said second turnaround compartment, wherein said return auger is mounted with one end thereof substantially coextensive with said other end of said brush roll and communicates with said second turnaround compartment, and wherein the other end of said return auger extends beyond said one end of said brush roll into said first turnaround compartment.

8. The developer defined in claim 7 wherein said supply and return augers are of substantially the same diameter, have substantially the same pitch, and said return auger rotates at a lower speed than said supply auger.

9. The developer defined in claim 8 wherein the number of flutes on said supply auger is related to the number of flutes on said return auger in the ratio of approximately 2 to 1.

10. The developer defined in claim 9 wherein said supply and return augers are formed of a material having a low triboelectric affinity for said toner.

11. An auger fed magnetic brush developer wherein toner-coated magnetic carrier beads are supplied to a rotating magnetic brush roll at a bottom-located pickup zone, and are then conveyed by said brush roll to a vertically elevated development zone, the improvement comprising:

a multiflute supply auger mounted in parallel axial alignment, substantially vertically below said brush roll, said supply auger being at least as long axially as said brush roll and being operable during rotation of said supply auger to elevate said carrier beads along the entire length of said brush roll's axially extending pickup zone, and to receive carrier beads from said entire length of said brush roll's axially extending development zone, and to transport the same under said supply uger and axially along said auger prior to reelevation to said pickup zone, said supply auger having a relatively large number of flutes to insure uniform distribution of said carrier beads along the length of said brush roll's pickup zone, said flutes having a relatively long pitch to insure that carrier beads reelevated to said pickup zone a minimum number of times prior to reaching the discharge end of said supply auger, a multiflute return auger having a length substantially equal to the length of said supply auger, mounted in parallel axial alignment, and substantially horizontally displaced from said supply auger, said return auger having a relatively small number of flutes to insure adequate mixing of toner carrier beads prior to delivery of the carrier beads to the intake end of said supply auger, housing means separating said supply and return augers to thereby define a recirculating bead flow path whereby the discharge end of said supply auger communicates with the intake end of said return auger at a first turnaround compartment, and whereby the discharge end of said return auger communicates with the intake end of said supply auger at a second turnaround compartment, and means for supplying new toner to said first turnaround compartment.

12. The developer defined in claim 11 wherein said supply and return augers are longer in axial length than is said brush roll, and wherein said augers are axially offset such that the discharge end of each auger is substantially coextensive with opposite ends of said brush roll, to thereby expose an axial length of the intake end of each auger to a turnaround compartment.

13. The developer defined in claim 12 wherein said supply auger includes at least four flutes to thereby provide uniform axial flow between said supply auger and said brush roll at said pickup zone.

14. The developer defined in claim 13 wherein said return auger is driven at a faster rotational speed than said supply auger to insure mixing and triboelectric charging of said toner and carrier beads with substantially the same flow rate as said supply auger.

15. The developer defined in claim 14 wherein the intake end of said return auger includes a short auger of a configuration to insure greater mixing of said toner and carrier beads than along the remaining length of said return auger.

16. The developer defined in claim 14 wherein said supply and return augers are of like diameters, wherein the return auger includes two flutes, and wherein the flute pitch of both augers is approximately equal to one-half the length of said brush roll.

* * * * *